US008264374B2

(12) United States Patent
Obatake et al.

(10) Patent No.: US 8,264,374 B2
(45) Date of Patent: Sep. 11, 2012

(54) WIRELESS DATA TRANSMITTING AND RECEIVING SYSTEM

(75) Inventors: Takayoshi Obatake, Nishinomiya (JP); Yasunobu Kaneyama, Osaka (JP); Toshihiko Kushida, Osaka (JP); Tatsuo Hirai, Otsu (JP)

(73) Assignee: Maeda Metal Industries, Ltd., Osaka (JP)

( * ) Notice: Subject to any disclaimer, the term of this patent is extended or adjusted under 35 U.S.C. 154(b) by 384 days.

(21) Appl. No.: 12/759,819

(22) Filed: Apr. 14, 2010

(65) Prior Publication Data

US 2010/0265097 A1 Oct. 21, 2010

(30) Foreign Application Priority Data

Apr. 16, 2009 (JP) ..... 2009-99764

(51) Int. Cl.
*G08C 15/00* (2006.01)

(52) U.S. Cl. ..... 340/870.4; 701/41

(58) Field of Classification Search ..... 340/870.4; 701/41, 42, 43, 99; 73/862.36, 862.21, 862.22, 73/862.23; 81/55, 57.13, 57.14
See application file for complete search history.

(56) References Cited

U.S. PATENT DOCUMENTS 5,542,304 A * 8/1996 Sasada et al. ..... 73/862.333

FOREIGN PATENT DOCUMENTS

| | | | |
|---|---|---|---|
| DE | 42 10 201 | A1 | 9/1993 |
| DE | 198 46 947 | A1 | 4/2000 |
| DE | 199 61 374 | A1 | 6/2001 |
| EP | 1 439 035 | A1 | 7/2004 |
| EP | 1 614 506 | A1 | 1/2006 |
| JP | 2006-021272 | A | 1/2006 |
| WO | 03/013797 | A1 | 2/2003 |

* cited by examiner

*Primary Examiner* — Joseph Lauture
(74) *Attorney, Agent, or Firm* — Eckert Seamans Cherin & Mellott, LLC; Kirk D. Houser

(57) ABSTRACT

There is provided a wireless data transmitting and receiving system that wirelessly transmits a signal regarding a torque acting on a rotary shaft and/or a rotation angle of the rotary shaft from a data transmitting unit disposed in the rotary shaft to a data receiving unit. The wireless data transmitting and receiving system includes: a data transmitting unit (20) provided on the rotary shaft (52) of a tightening machine (50) to detect the torque and the rotation angle, the data transmitting unit (20) including a torque sensor (21) disposed so as to be capable of sensing a toque acting on the rotary shaft (52), a rotation angle sensor (29) disposed so as to be capable of a rotation angle of the rotary shaft (52), and transmitting means (22) that is electrically connected to the foregoing sensors (21,29), and wirelessly transmits signals regarding the torque detected in the torque sensor (21) and the rotation angle detected in the rotation angle sensor (29); and a data receiving unit (30) including receiving means (32) that receives the transmitted signals regarding the torque and the rotation angle, and display means (40) that displays the signals regarding the torque and the rotation angle received by the receiving means (32).

16 Claims, 7 Drawing Sheets

WIRELESS DATA TRANSMITTING AND RECEIVING SYSTEM

BACKGROUND OF THE INVENTION

1. Field of the Invention

The present invention relates to a wireless data transmitting and receiving system that detects a torque and/or a rotation angle from a torque sensor and/or a rotation angle sensor disposed in a rotary shaft of a tightening machine to tight a bolt, a nut, a screw or the like, and wirelessly transmits the same to a data receiving unit.

2. Description of the Related Art

In a tightening machine that performs tightening by a torque method, a tightening torque is controlled by detecting a load of a power machine, that is, a current value of the power machine and using the current value as an index. In this method of detecting the current value to control the tightening torque, if the current value varies due to the variation of a voltage or the like, an accurate tightening torque cannot be obtained. Furthermore, since force is transmitted to a rotary shaft from the power machine through a deceleration mechanism, the tightening torque is affected by a transmission efficiency of the deceleration mechanism. That is, when the tightening machine continues to be used with a tightening torque to a current value of a new tightening machine, conformability is generated in the deceleration mechanism, which increases the transmission efficiency of the deceleration mechanism, resulting in too high a tightening torque to the same current value. Accordingly, for confirming the actual tightening torque, additional work of measuring an increasingly tightening torque by a wrench after tightening or the like is necessary.

In order to solve this problem, there is proposed a tightening machine of a bolt, a nut, a screw and the like that is equipped with a tightening-torque measuring unit to detect and display a tightening torque (e.g., refer to Japanese Patent Application Laid-Open No. 2006-21272).

In the tightening machine of Patent Literature 1, the tightening-torque measuring unit has a torque sensor such as a strain gauge, and display means electrically connected to the torque sensor, and the tightening-torque measuring unit is directly attached to a rotary shaft of the tightening machine so that the tightening torque can be detected and displayed.

In the tightening machine of Patent Literature 1, the rotary shaft to which the tightening-torque measuring unit is attached is made up of an inner shaft and an outer shaft that can rotate in a reverse direction to each other, and has a reaction force receiver at an outer shaft terminal end. The tightening-torque measuring unit is disposed in the outer shaft to which the reaction force receiver is attached. That is, since the tightening-torque measuring unit rotates integrally with the outer shaft, the display means cannot be sufficiently checked visually during rotation of the outer shaft or at some rotation stop positions of the outer shaft.

Moreover, in the case where the rotary shaft is put in the recessed portion in tightening a bolt or the like in a recessed portion or the like, the tightening-torque measuring unit is in the recessed portion, which may disable the tightening torque to be visually checked.

That is, in the tightening machine of Patent Literature 1, since the tightening-torque measuring unit is attached to the outer shaft side of the rotary shaft, and the display means is provided in the tightening-torque measuring unit, during the tightening, the tightening-torque measuring unit may move to a position where visual check is disabled, or at some rotation stop positions of the outer shaft, the display means cannot be visually checked. Moreover, the tightening-torque measuring unit is attached to the outer shaft side, and thus, when the actual tightening is performed by the inner shaft and the reaction force is received by the outer shaft, a difference between a torque acting on the outer shaft and a torque acting on the inner shaft actually performing the tightening may be caused.

Furthermore, in the tightening machine of Patent Literature 1, in order to display a torque value detected by the tightening-torque measuring unit on a display provided on the tightening machine body side, the tightening-torque measuring unit and the display need to be connected by a signal line (wired). However, since the tightening-torque measuring unit rotates together with the rotary shaft, the signal line may wind around the tightening-torque measuring unit, or may jam during working, which causes a possibility of disconnection. Moreover, since in the signal line, electric noise is easily carried, it can be considered that the accurate torque value is not sent. Although an electric-signal transmitting mechanism by a collector ring or the like can also be considered, the tightening-torque measuring unit itself is increased in size, leading to a deterioration of workability.

Moreover, in a tightening machine that performs tightening by a rotation-angle control method, an encoder is attached to a rotary shaft of a power machine, or a slit plate and a photo interrupter are attached to the rotary shaft to detect the number of rotations of the power machine, and a rotation angle of the rotary shaft is controlled with a count of the number of rotations used as an index. In this case as well, since the rotation is transmitted to the rotary shaft through a deceleration mechanism from the power machine, the control is affected by elastic deformation of the deceleration mechanism and the like.

Accordingly, although the actual rotation angle of a nut after tightening can be visually confirmed roughly, additional work by an angle gauge or the like after tightening is necessary for confirming the accurate tightening angle.

Furthermore, in a tightening machine that performs tightening by a torque gradient method, a gradient of a torque to a rotation angle of a nut is detected to perform control with variation of a value thereof used as an index.

However, in the current tightening machine that performs the tightening by the torque gradient method, since for the torque, a current value of the power machine is used as an index and for the rotation angle, a tightening time is used as an index, a gradient of the current value of the power machine to the tightening time is detected instead of the gradient of the torque to the rotation angle of the nut so as to perform the control with the variation of the value used as the index, thereby resulting in fluctuation of accuracy. Moreover, the tightening confirmation is performed by actually tightening several bolts and graphing the current value of the power machine to the tightening time at each point, and thus, devices to detect the tightening time and the current time thus need to be connected to the tightening machine.

Furthermore, in the current tightening machine, in the case where with a predetermined torque set for the tightening machine, a bolt already tightened is to be further tightened, if the torque of the bolt is less than the predetermined torque, the bolt is rotated to be tightened with the predetermined torque. However, even in the case where the bolt has already been tightened with a torque larger than the predetermined torque, when the rotary shaft of the tightening machine reaches the predetermined torque, the tightening is finished even if the bolt is not rotated, and it is determined that the bolt has been tightened with the predetermined torque.

An object of the present invention is to provide a wireless data transmitting and receiving system capable of wirelessly transmitting a signal regarding a torque acting on a rotary shaft and/or a rotation angle of the rotary shaft from a data transmitting unit disposed in the rotary shaft to a data receiving unit.

SUMMARY OF THE INVENTION

In order to solve the above-described problems, a wireless data transmitting and receiving system of the present invention includes:

a data transmitting unit provided on a rotary shaft of a tightening machine and having a function of detecting a torque, the data transmitting unit including a torque sensor disposed so as to be capable of sensing a toque acting on the rotary shaft, and transmitting means that is electrically connected to the torque sensor and wirelessly transmits a signal regarding the torque detected in the torque sensor; and a data receiving unit including receiving means that receives the signal regarding the torque transmitted from the transmitting means of the data transmitting unit, and display means that displays the signal regarding the torque received by the receiving means.

Moreover, a wireless data transmitting and receiving system of the present invention includes:

a data transmitting unit provided on a rotary shaft of a tightening machine and having a function of detecting a rotation angle, the data transmitting unit including a rotation angle sensor disposed so as to be capable of sensing a rotation angle of the rotary shaft, and transmitting means that is electrically connected to the rotation angle sensor and wirelessly transmits a signal regarding the rotation angle detected in the rotation angle sensor; and a data receiving unit including receiving means that receives the signal regarding the rotation angle transmitted from the transmitting means of the data transmitting unit, and display means that displays the signal regarding the rotation angle received by the receiving means.

It is desirable that the data receiving unit is disposed on a body side of the tightening machine or inside a housing on a power wire that supplies power to the body, and includes, inside the tightening machine or the housing, a control circuit that controls a power machine rotating the rotary shaft, the control circuit being electrically connected to the receiving means to control the power machine based on the signal regarding the torque and/or the rotation angle received by the receiving means.

According to the wireless data transmitting and receiving system of the present invention, the data transmitting unit disposed directly in the rotary shaft allows the tightening torque acting on the rotary shaft and the rotation angle of the rotary shaft to be directly detected, and allows the detected tightening torque and rotation angle of the rotary shaft to be transmitted outside by the transmitting means. The transmitted signals regarding the torque and the rotation angle are received by the receiving means of the data receiving unit, which can be disposed at the position where it is not rotated integrally with the rotary shaft, and are displayed on the display means.

Since the tightening torque acting on the rotary shaft can be directly detected and displayed, the actual tightening torque need not be further measured to be confirmed. Moreover, since the rotation angle of the rotary shaft can also be detected and displayed, the rotary shaft need not be actually measured after tightening.

Since the data receiving unit is configured separately from the data transmitting unit, in the case where the rotary shaft is put in a recessed portion to perform tightening, or the like, even if the data transmitting unit is in the recessed portion where the visual check is disabled, the tightening torque and/or the rotation angle are (is) displayed on the display means provided in the data receiving unit, so that visual check is enabled.

Since the display means is connected to the receiving means, and the display means is not rotated integrally with the rotary shaft, the defect that the display means cannot be visually checked due to the rotation of the rotary shaft or due to the stop position or the like can be resolved, and accurate tightening can be performed while confirming the display means.

Moreover, transmitting the data from the data transmitting unit to the data receiving unit eliminates a connection object such as a signal line between the data transmitting unit and the data receiving unit. Accordingly, the workability is not adversely affected. Moreover, the influence by electric noise is less than that in a wired case.

Furthermore, since the display means is not necessary in the data transmitting unit, the data transmitting unit can be downsized and reduced in weight, and further, since a power source to operate the display means is not necessary, either, a battery as the power source can be downsized and have extended life.

In a tightening machine performing tightening by a torque method, since the tightening torque is directly detected from the rotary shaft, utilizing this tightening torque for control enables more accurate tightening by the torque method as compared with control by a current value of the power machine.

In a tightening machine performing tightening by a rotation-angle control method, since the rotation angle of the rotary shaft is directly detected, utilizing this rotation angle for control enables more accurate tightening by the rotation-angle control method as compared with control by the number of rotations of the rotary shaft of the power machine.

In a tightening machine performing tightening by a torque gradient method, the tightening toque and the rotation angle can be directly detected from the rotary shaft, a gradient of the torque to this rotation angle is detected, and variation of the value is utilized for control, which enables tightening by the primary torque gradient method, so that more accurate tightening by the torque gradient method can be performed as compared with control by detecting a gradient of the current value of the power machine to a tightening time to perform control in accordance with the variation of the value. Moreover, since the signals of the torque and the rotation angle can be transmitted from a single data transmitting unit, the torque and the rotation angle can be synchronized. Furthermore, since the rotation angle is also detected, a rotation speed can be detected from the tightening time and the rotation angle.

In the tightening machine capable of directly detecting the tightening torque and the rotation angle from the rotary shaft, when with a predetermined torque set for the tightening machine, a bolt already tightened is to be tightened, if the torque of the bolt is less than the predetermined torque, the bolt is rotated so as to be tightened with the predetermined torque. However, if the bolt has been already tightened with a torque larger than the predetermined torque, the rotary shaft of the tightening machine is not rotated even when the predetermined toque is reached. Accordingly, by detecting whether the rotary shaft of the tightening machine is rotated from the tightening start to the predetermined torque, the acceptance can be determined as to whether or not the bolt is tightened within a range of the predetermined toque, or whether or not the bolt has been tightened with a torque larger than the predetermined torque. A buzzer, a lamp or the like as notifying means is connected to the receiving means, by which when the bolt has been tightened with a torque larger than the predetermined torque, the worker can be informed that the torque is unacceptable by sound or light, so that the worker can easily recognize that the torque larger than the predetermined torque has been applied. Moreover, when the torque larger than the predetermined torque is applied, the tightening machine can be reversely rotated to loosen the bolt, and again, can be positively rotated to retighten the bolt up to the predetermined torque.

Moreover, storage means of a personal computer, an external memory or the like is included in, or cooperates with the receiving means, by which the signal regarding the torque and/or the rotation angle can be stored, managed, outputted and the like. This allows a tightening state of the bolt or the like to be remotely stored, managed, outputted and the like. Particularly, in the case where the tightening is performed by the torque gradient method, a device to detect the current value and the like for tightening confirmation need not be connected to the tightening machine.

Furthermore, the receiving means is disposed in the tightening machine, and a setting switch is connected to the receiving means so that a desired tightening torque is inputted by the setting switch in advance, by which the received signal regarding the torque is fed back for the power control of the power machine of the tightening machine, and thereby, the bolt or the like can be tightened with the desired tightening torque. This enables more accurate tightening as compared with the torque detection by load sensing of the power machine or the like.

DETAILED DESCRIPTION OF THE PREFERRED EMBODIMENTS

Figure 1:
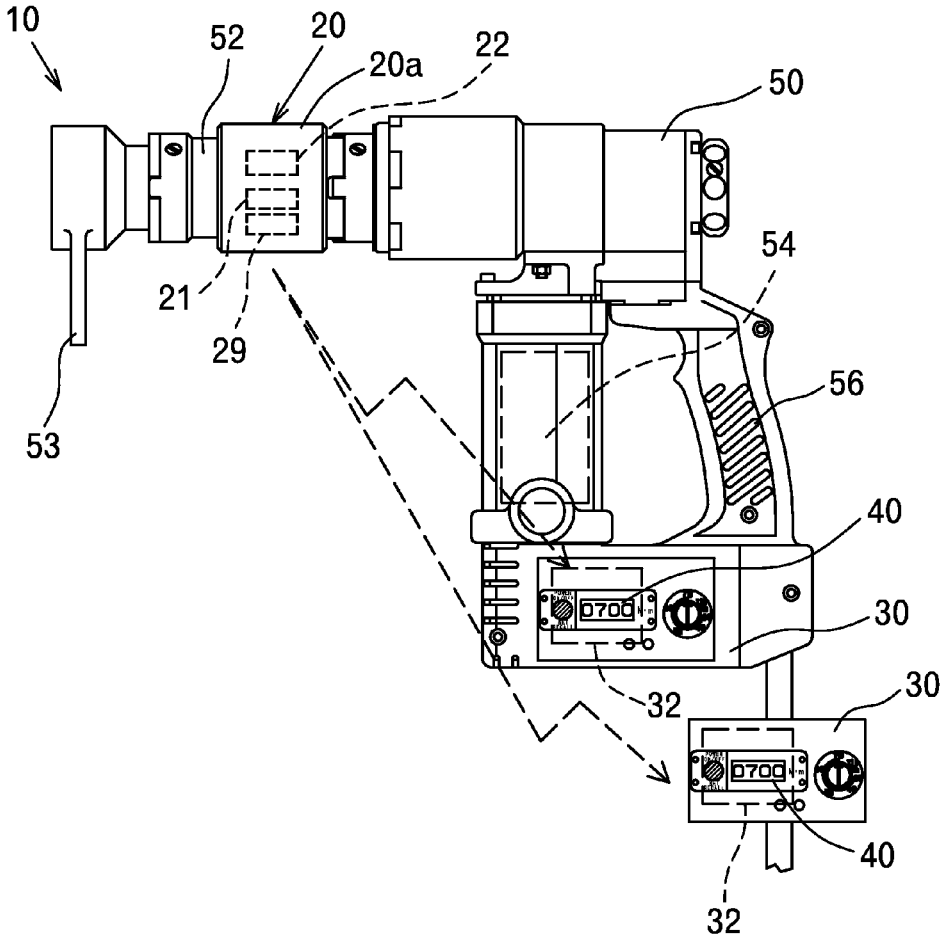
FIG. 1 is a configuration diagram of a wireless data transmitting and receiving system of the present invention.

A wireless data transmitting and receiving system 10 of the present invention, as shown in FIG. 1, is made up of a data transmitting unit 20 disposed in a rotary shaft 52 of a tightening machine 50, and a data receiving unit 30 that receives a wireless signal regarding a torque from the data transmitting unit 20 to perform various operations.

In the present specification, the "rotary shaft" 52 of the tightening machine 50, in the case of one shaft, includes a rotary shaft and various shafts that rotate accompanying the rotation thereof, and in the case of two shafts made of an inner shaft and an outer shaft as described in the background art, includes these shafts and various shafts that rotate accompanying the rotations thereof. A reaction force receiver 53 may be attached to the rotary shaft 52.

Moreover, while in the following description, the data transmitting unit 20 that can both detect a torque acting on the rotary shaft 52 and a rotation angle of the rotary shaft 52 is described, obviously, the data transmitting unit 20 can be adapted to be capable of detecting any one of them.

The data transmitting unit 20, as shown in FIG. 1, is housed in a tubular casing 20*a* attached to the rotary shaft 52 of the tightening machine 50 in a detachable or fixed manner. The detachable data transmitting unit 20 advantageously enables only the data transmitting unit 20 to be exchanged with a spare data transmitting unit (not shown) when there is a defect in the data transmitting unit 20. Moreover, a same number of data transmitting units 20 and tightening machines 50 need not be possessed in sets, which is economical.

Figure 2:
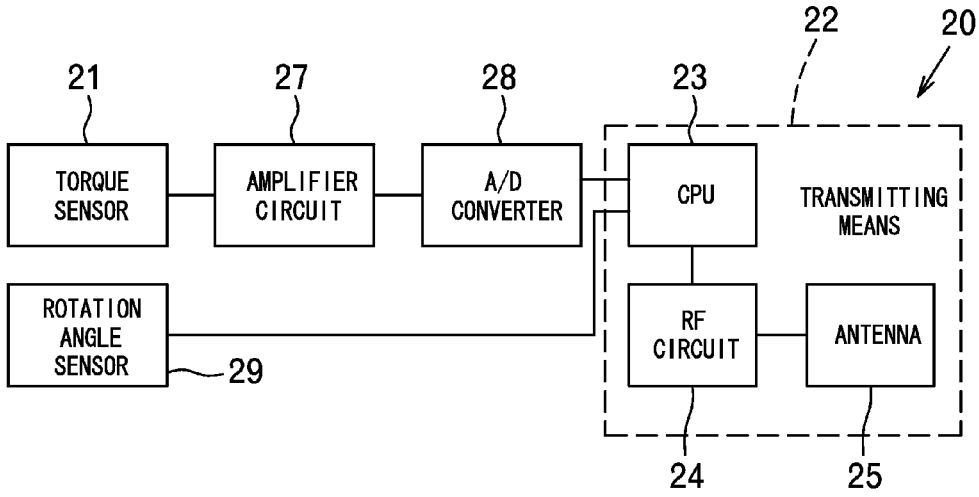
FIG. 2 is a block diagram of a data transmitting unit.

The data transmitting unit 20, as shown in FIG. 2, is essentially made up of a torque sensor 21, a rotation angle sensor 29, transmitting means 22 for transmitting a signal regarding a torque and/or a rotation angle outputted from the torque sensor 21 and/or the rotation angle sensor 29.

The torque sensor 21 electrically senses the torque acting on the rotary shaft 52, and for example, a strain gauge (not shown) placed on the rotary shaft 52 can be exemplified.

The variation of the torque generated in the rotary shaft 52 is outputted from the torque sensor 21 as the signal regarding the torque. For example, in the case of the strain gauge, the variation of the torque generated in the rotary shaft 52 is sensed as resistance variation, and is outputted as voltage variation.

In the case where the rotary shaft 52 is made up of the outer shaft and the inner shaft, the torque sensor 21 is placed on any one of the outer shaft and the inner shaft. When the reaction force receiver 53 is provided in the outer shaft, in the shaft on the side where the reaction force receiver 53 is disposed, there may occur a difference in acting torque from the shaft actually performing the tightening. Accordingly, in this case, it is desirable to attach the data transmitting unit 20 to the inner shaft side actually performing the tightening, which allows a more accurate tightening torque to be detected as compared with a case where the data transmitting unit 20 is attached to the outer shaft side.

The rotation angle sensor 29 electrically senses the rotation angle of the rotary shaft 52, and for example, an encoder, a gyro sensor, a photo interrupter, or a magnetic sensor attached to the rotary shaft 52 or the rotary shaft 52 and a non-rotating portion can be exemplified. In each case, the rotary angle sensor 29 is attached to the shaft actually performing the tightening.

The rotation angle of the rotary shaft 52 is outputted from the rotation angle sensor 29 as the signal regarding the rotation angle. For example, in the case of the encoder, an encoder pulse is outputted as the signal regarding the rotation angle of the rotary shaft 52. Moreover, in the case of the gyro sensor, an absolute angular velocity is outputted as the signal regarding the rotation angle of the rotary shaft 52. In the case of the photo interrupter, a light-receiving portion senses light emitted by a light-emitting portion, by which the rotation of the rotary shaft 52 is outputted as a digital signal.

The signals outputted from the torque sensor 21 and the rotary angle sensor 29 are transmitted to the transmitting means 22. The transmitting means 22 includes a CPU 23, an RF (Radio Frequency) circuit 24for transmission, and an antenna 25 for transmission. Moreover, on the casing 20*a*, a battery (not shown) as a power source is mounted to supply the power to the respective devices.

An amplifier circuit 27 and an A/D converter 28 are disposed between the torque sensor 21 and the CPU 23 of the transmitting means 22, and the signal regarding the torque outputted from the torque sensor 21 is amplified in the amplifier circuit 27, and is subjected to A/D conversion in the A/D converter 28 to be transmitted to the CPU 23.

The rotation angle sensor 29, in the case of the device that outputs the digital signal, such as the encoder, can be connected to the CPU 23 so as to directly transmit the signal. In the case of the device that outputs an analog signal, the signal is amplified by an amplifier circuit (not shown) as needed, and the amplified signal is subjected to the A/D conversion using an A/D converter (not shown) to transmit to the CPU 23.

The CPU 23 wirelessly transmits the signals regarding the torque and the rotation angle from the RF circuit 24 through the antenna 25. When the antenna 25 is located on the opposite side of the data receiving unit 30 by the rotation of the data transmitting unit 20, a carrier wave (radio wave, infrared ray or the like) may be blocked off. In such a case, disposing a plurality of antenna 25 at every predetermined angle in the data transmitting unit 20 allows any one of the antennas 25 to be located on the data receiving unit 30 side, and thus, secure transmission can be performed without the carrier wave being blocked off.

Since by directly disposing the data transmitting unit 20 in the rotary shaft 52, the tightening torque acting on the rotary shaft 52 and the rotation angle of the rotary shaft 52 can be directly detected, even in the tightening machine 50 in which a deceleration mechanism (not shown) is disposed between the rotary shaft 52 and the power machine (motor 54), the accurate tightening torque and rotation angle of the rotary shaft 52 can be detected without influence such as variation in efficiency, elastic deformation and the like of the deceleration mechanism.

From the data transmitting unit 20, the signals can be wirelessly sent out over radio wave or infrared ray. Moreover, a configuration utilizing a wireless LAN and a wireless personal area network (WPAN) can also be established.

The transmitted signals regarding the torque and the rotation angle are received by the data receiving unit 30 shown in FIG. 1. The data receiving unit 30, as described later, can be provided separately from the tightening machine 50, or be attached in a state where it is fixed to the tightening machine 50 by screws or the like. Alternatively, it can be provided integrally with the tightening machine 50.

Figure 5:
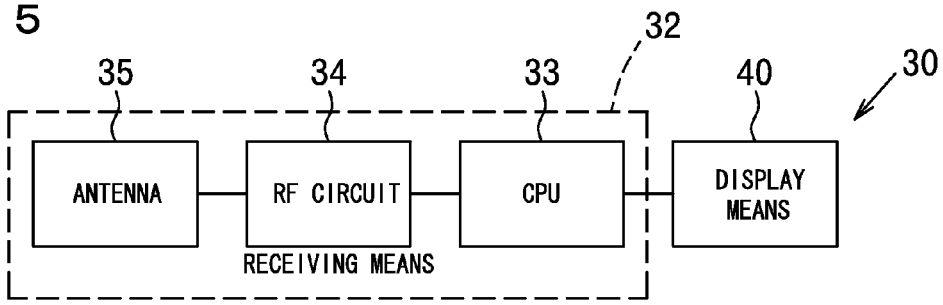
FIG. 5 is a block diagram of the data receiving unit to which the display means is applied.

The data receiving unit 30 has, as receiving means 32, an antenna 35 for reception, an RF circuit 34 for reception and a CPU 33, as shown in FIG. 5. The received signal regarding the torque is transmitted to the CPU 33 through the antenna 35 and the RF circuit 34, and the signal regarding the torque can be converted to a torque value and various types of control, storage, management, output and the like based on the torque can be performed.

Similarly, the received signal regarding the rotation angle is also transmitted to the CPU 33 through the antenna 35 and the RF circuit 34, and the signal regarding the rotation angle can be converted to a rotation angle value and various types of control, storage, management, output and the like based on the rotation angle can be performed.

The received signals regarding the torque and the rotation angle can be displayed on display means 40 electrically connected to the receiving means 32. This allows the received signals regarding the torque and the rotation angle to be visually checked as the torque value and the angle value.

For the power supply to the data receiving unit 30, a battery can be utilized or a commercial power source can be used.

In the drawings, various examples of the data receiving unit 30 are shown.

As shown in FIG. 1, the data receiving unit 30 can be provided integrally with the tightening machine 50. In this case, it is desirable that the data receiving unit 30 is provided on a power wire that supplies the power to the power machine (e.g., the motor 54) rotating the rotary shaft 52 of the tightening machine 50, and that a control circuit that controls the power machine and the receiving means 32 are electrically connected. This allows the power machine (motor 54) to be subjected to feedback control and the like, based on the signal regarding the torque and/or the rotation angle received by the receiving means 32.

Figure 3:
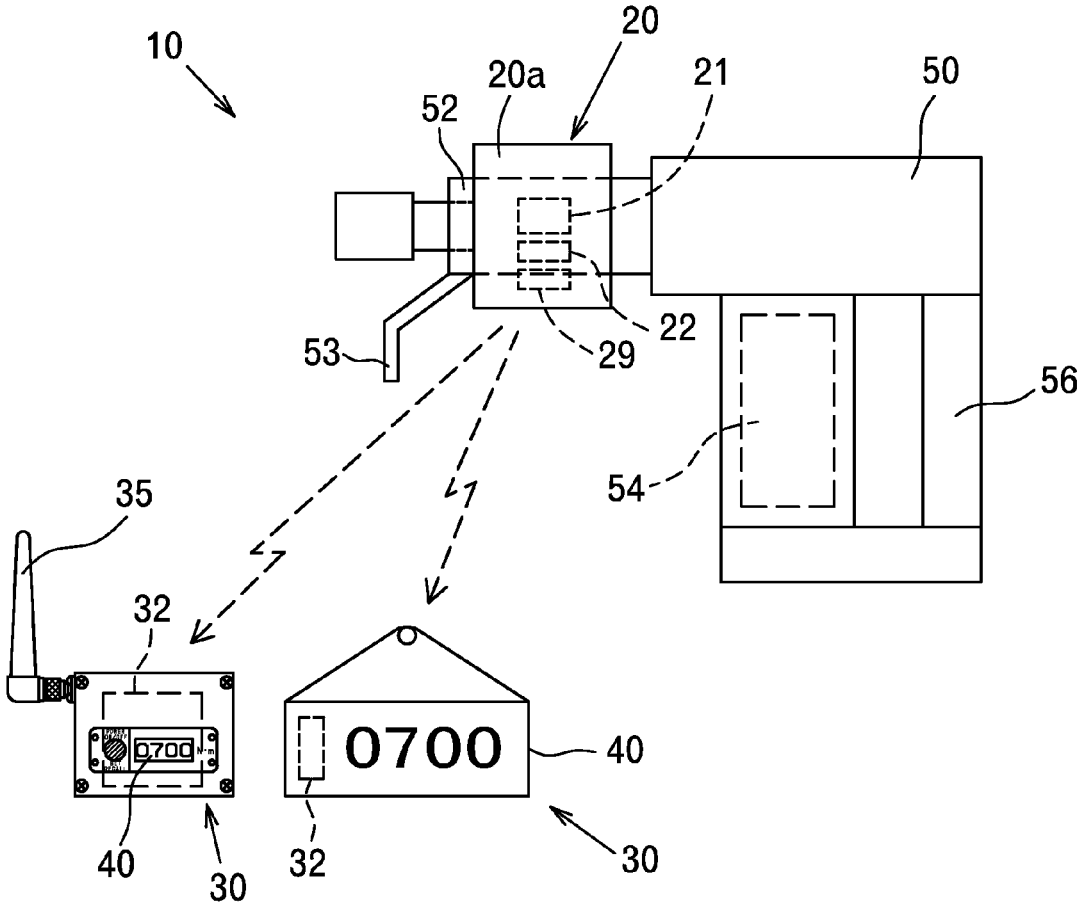
FIG. 3 is a configuration diagram showing the wireless data transmitting and receiving system in which display means is applied to a data receiving unit.

As shown in FIG. 3, the data receiving unit 30 can be provided separately from the tightening machine 50. In this case, as the display means 40, a liquid crystal display (LCD) can be exemplified as shown in FIG. 3, and the measured torque value and/or rotation angle can be displayed on the liquid crystal display.

The data receiving unit 30 with the display means 40 can be manufactured with a desired size and shape of characters, and a magnitude, a color, a display time and the like of the displayed torque value and/or rotation angle can be also set as needed. Moreover, a form such as a wristwatch may be employed.

The display means 40 is fixed, rested against a wall, suspended or the like at a position where a worker can easily watch it, by which the worker can tighten a bolt or the like up to a desired torque value and/or rotation angle while visually checking the display means.

A power source of the display means 40 can be disposed separately from the data transmitting unit 20, and thus, a battery disposed in the data transmitting unit 20 or the like can be downsized and have extended life.

Figure 4:
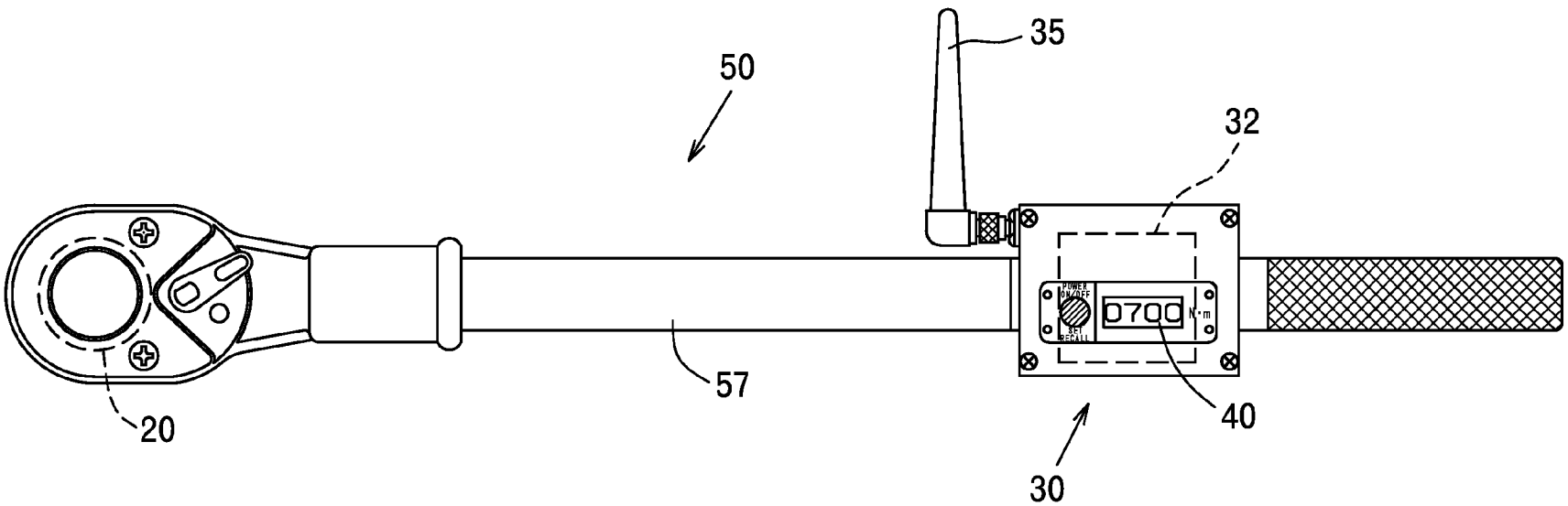
FIG. 4 is a plain diagram showing an example in which the present invention is applied to a manual wrench.

As shown in FIG. 4, the tightening machine is not limited to an electric one, but can be applied to the manual tightening machine 50. In this case, the display means 40 is fixed at a position where the worker can easily watch it, for example, a handle portion 57 closer to the tightening side than a portion where the worker grips a handle, thereby allowing the worker to tighten a bolt or the like up to the desired torque value and/or rotation angle while adjusting the input by visually checking the display means 40.

Figure 6:
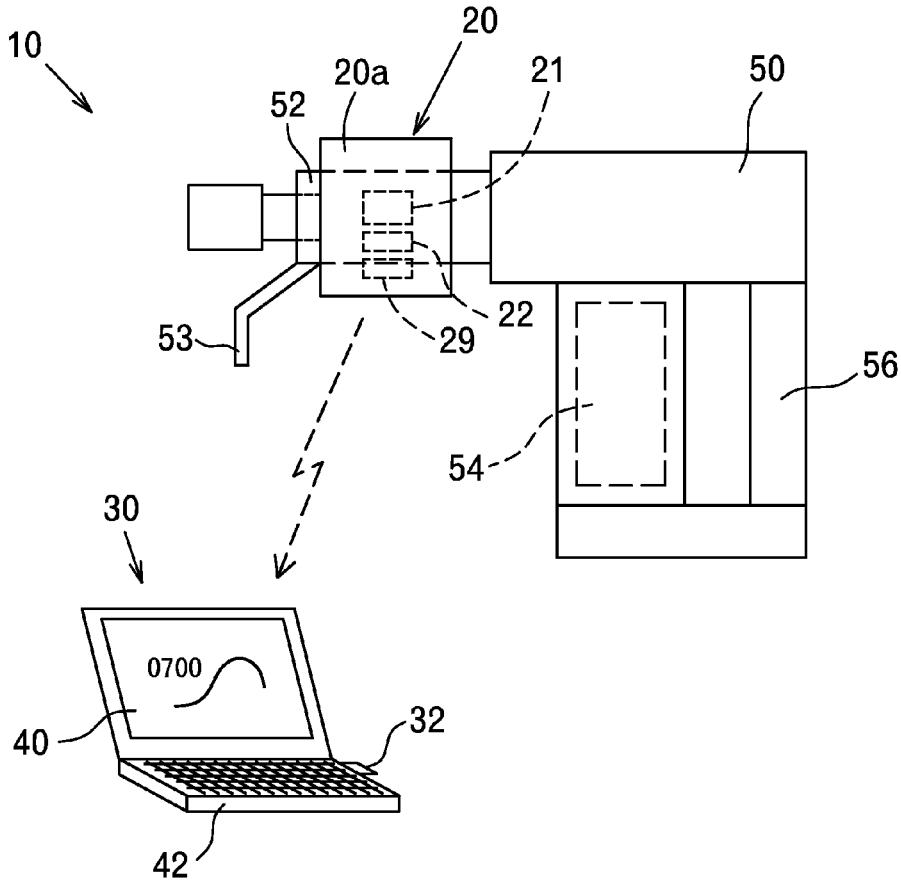
FIG. 6 is a configuration diagram of the wireless data transmitting and receiving system in which a personal computer is applied to the data receiving unit.
Figure 7:
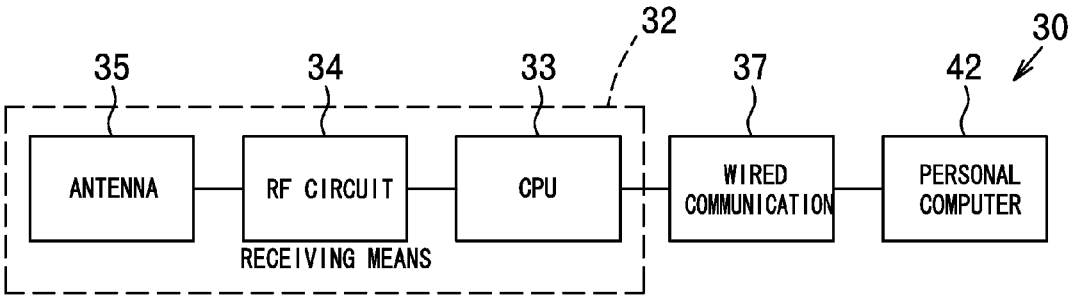
FIG. 7 is a block diagram of the data receiving unit to which the personal computer is applied.

The data receiving unit 30, as shown in FIGS. 6 and 7, may be configured so as to cooperate with a personal computer 42, or to be partially or entirely incorporated in the personal computer 42. In an illustrated example, the data receiving unit 30 cooperates with the personal computer 42 by wired communication 37.

The received signal regarding the torque is processed by the personal computer 42 to thereby be converted to the torque value, so that the tightening toque of the bolt or the like can be stored in storage means incorporated in, or connected to the personal computer 42 to be managed and outputted. Moreover, a monitor of the personal computer 42 can be utilized as the display means 40. Furthermore, the signal regarding the torque and/or the signal regarding the rotation angle can be fed back to the tightening machine 50 to control the tightening machine 50.

Figure 8:
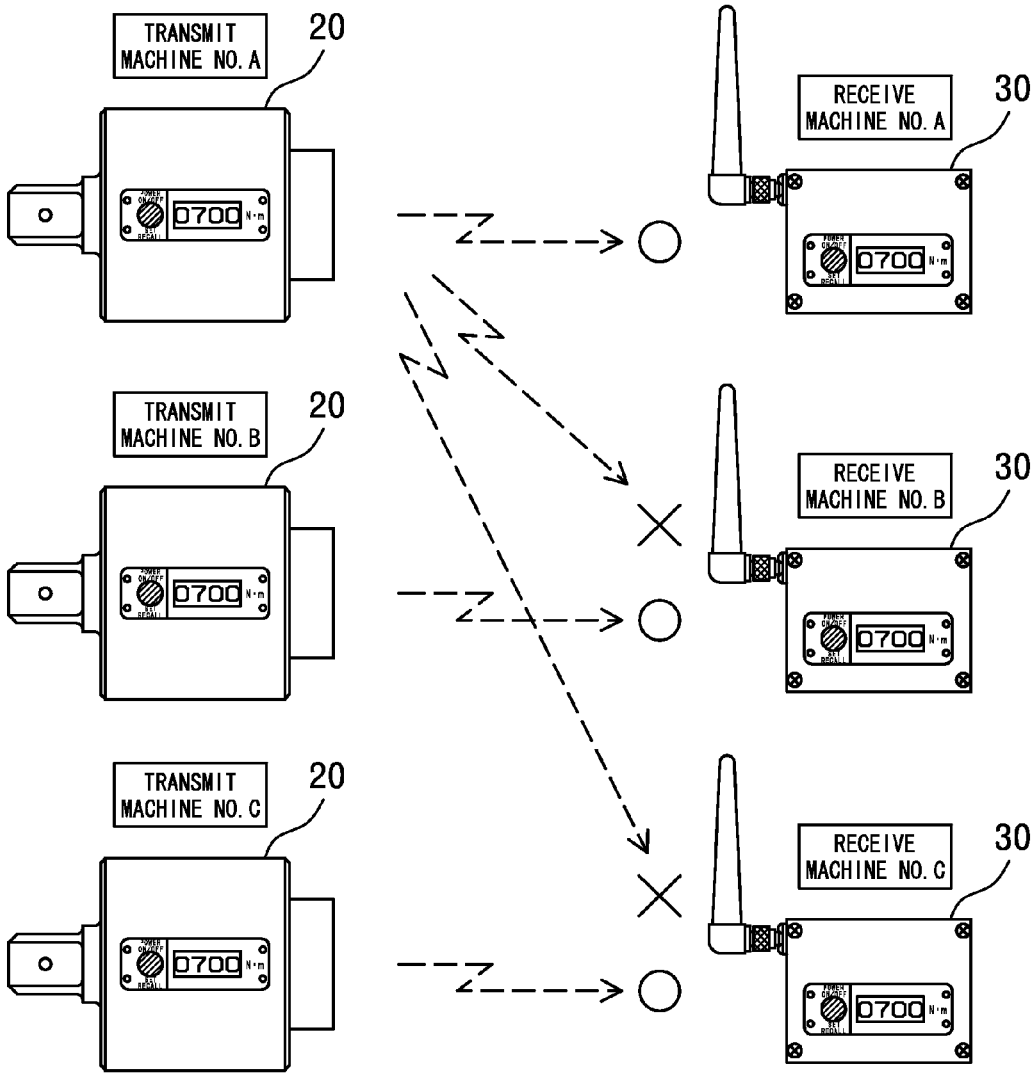
FIG. 8 is a schematic diagram when a plurality of wireless data transmitting and receiving systems are used.

An identification signal of the data transmitting unit 20 is inserted into the signal regarding the torque and/or the signal regarding the rotation angle transmitted from the data transmitting unit 20 of the tightening machine 50, and thereby, as shown in FIG. 8, in the case where a plurality of tightening units 50 are used, the torque values and/or the rotation angles are individually identified to be displayed, stored and the like even when a plurality of data transmitting units 20 and a plurality of data receiving unit 30 are used.

By installing a GPS (Global Positioning System) function in the data transmitting unit 20, for example, in bolt tightening of a bridge or the like, it can also be recorded and managed that each bolt was tightened with a predetermined torque and/or rotation angle. Also, a date and time may be recorded at the same time.

Furthermore, the received torque value and/or rotation angle may be graphed by the personal computer 42 to monitor a tightening process and determine presence or absence of abnormity occurring during the tightening.

Figure 9:
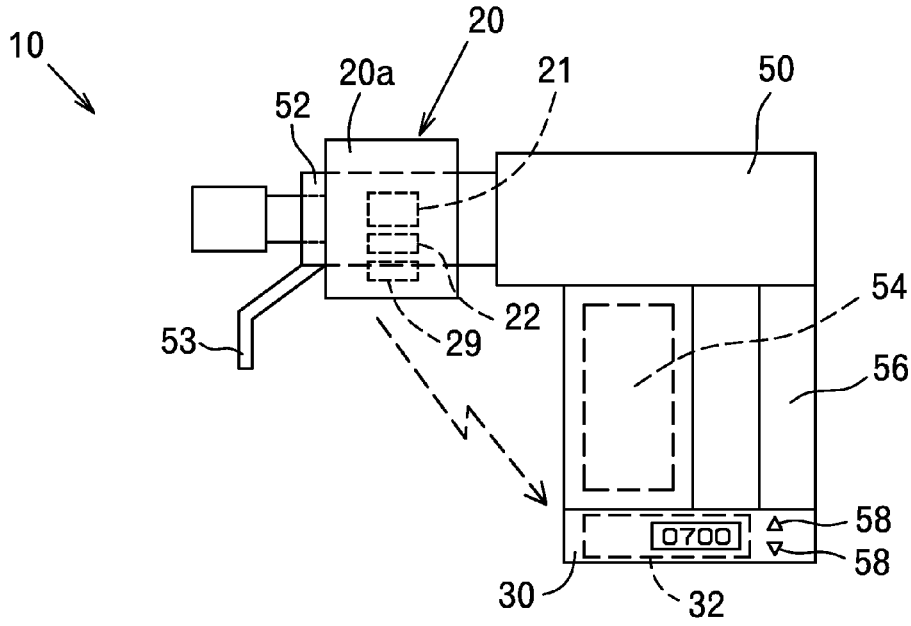
FIG. 9 is a configuration diagram of the wireless data transmitting and receiving system applied to a tightening machine with the data receiving unit mounted thereon.
Figure 10:
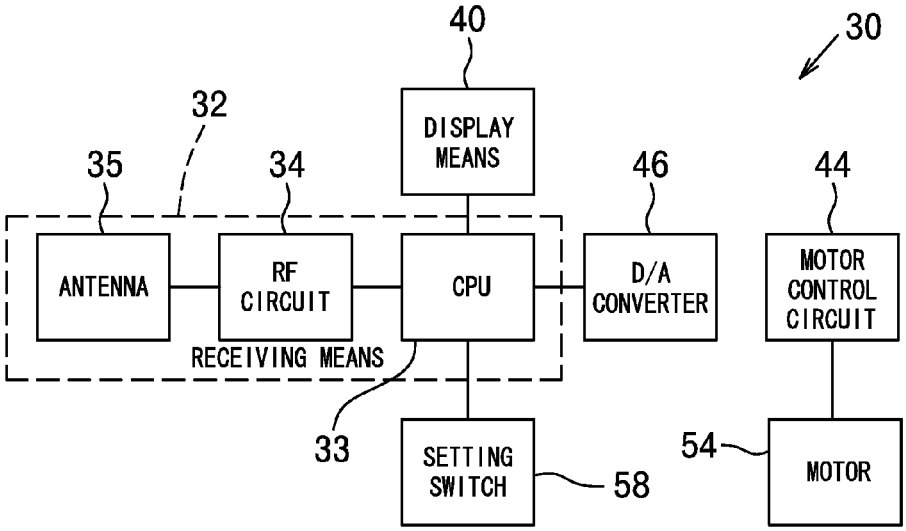
FIG. 10 is a block diagram of the tightening machine with the data receiving unit mounted thereon.

The data receiving unit 30, as shown in FIGS. 9 and 10, is attached directly to a grip portion 56 or the like of the tightening machine 50, so that the tightening torque value and/or the rotation angle can be visually checked, and so that the motor 54 as the power machine of the tightening machine 50 can be controlled based on the received torque value and/or rotation angle.

As one example, as shown in FIG. 9, a configuration can be exemplified, in which the display means 40 and switches 58 to set the desired tightening torque and/or rotation angle are disposed in the tightening machine 50, and as shown in FIG. 10, the display means 40 and the setting switches 58 cooperate with the CPU 33 of the data receiving unit 30, and further, a motor control circuit 44 that supplies the power to the motor 54 of the tightening machine 50 and the CPU 33 are connected through a D/A converter 46.

Moreover, the desired tightening toque or rotation angle is inputted in advance by the setting switches 58, by which the CPU 33 causes the motor control circuit 44 to control so as to block off the conduction to the motor 54 when the received torque value reaches the desired tightening toque or rotation angle, or so as to reduce the supply power to the motor 54 for deceleration when the received torque value or rotation angle becomes close to the desired torque or rotation angle. In this case, the torque value and/or rotation angle inputted in the display means 40 may be displayed.

According to the foregoing, since the tightening torque can be directly sensed from the rotary shaft 52 to control the motor 54, tightening can be performed with a more accurate tightening torque than when the tightening toque is controlled by load sensing of the motor.

Figure 11:
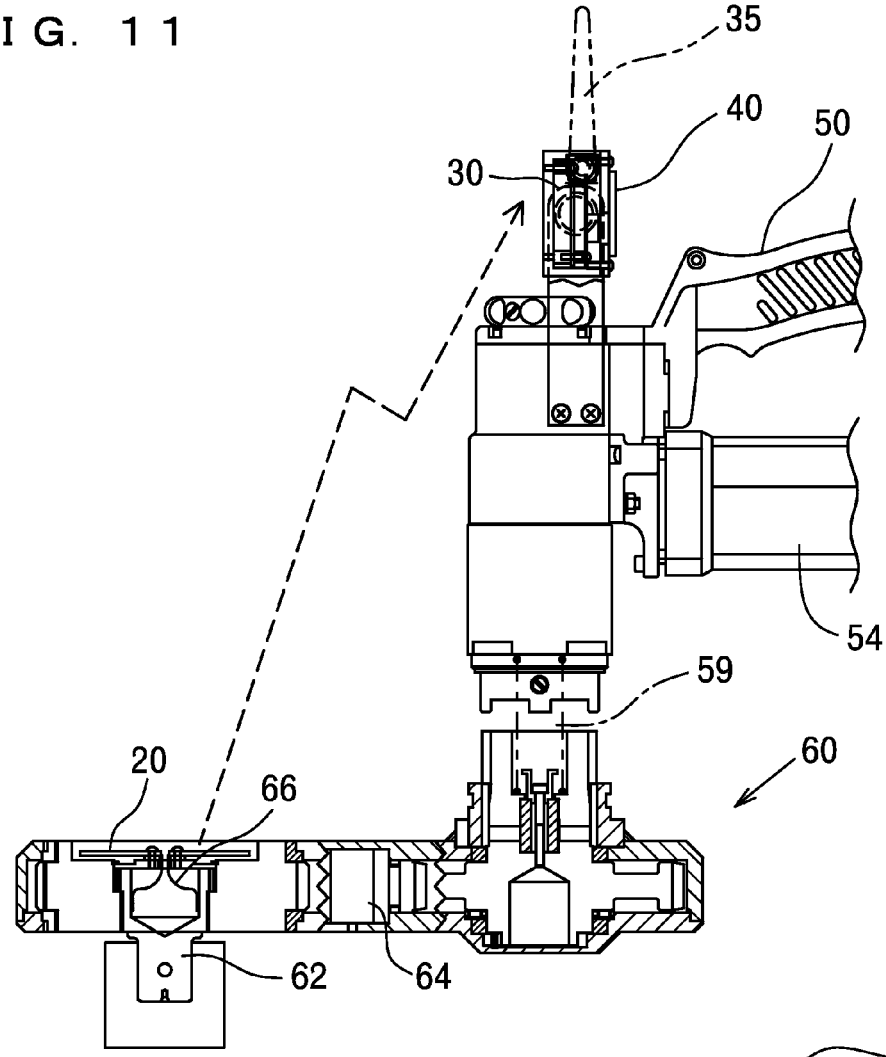
FIG. 11 is a partial cross-sectional diagram showing an example in which the present invention is applied to a tightening machine having a thin wrench.

FIG. 11 is an example suitable for the tightening machine 50 with a thin wrench 60 attached. The thin wrench 60 has a socket for tightening 62 at a position different from a rotation center of a socket 59 for the tightening machine 50. The socket 59 and the socket for tightening 62 are caused to cooperate with each other by a gear mechanism 64.

The data transmitting unit 20 is disposed inside the wrench 60 and the data receiving unit 30 is attached to the tightening machine 50 side.

In the tightening machine 50 with the wrench 60 of the present configuration, in tightening, the tightening toque is wirelessly transmitted from the data transmitting unit 20 to the data receiving unit 30, so that the tightening toque and/or the rotation angle can be visually checked on the display means 40 on the tightening machine 50 side, and the motor 54 as the power machine of the tightening machine 50 can be controlled based on the received torque value and/or rotation angle.

Figure 12:
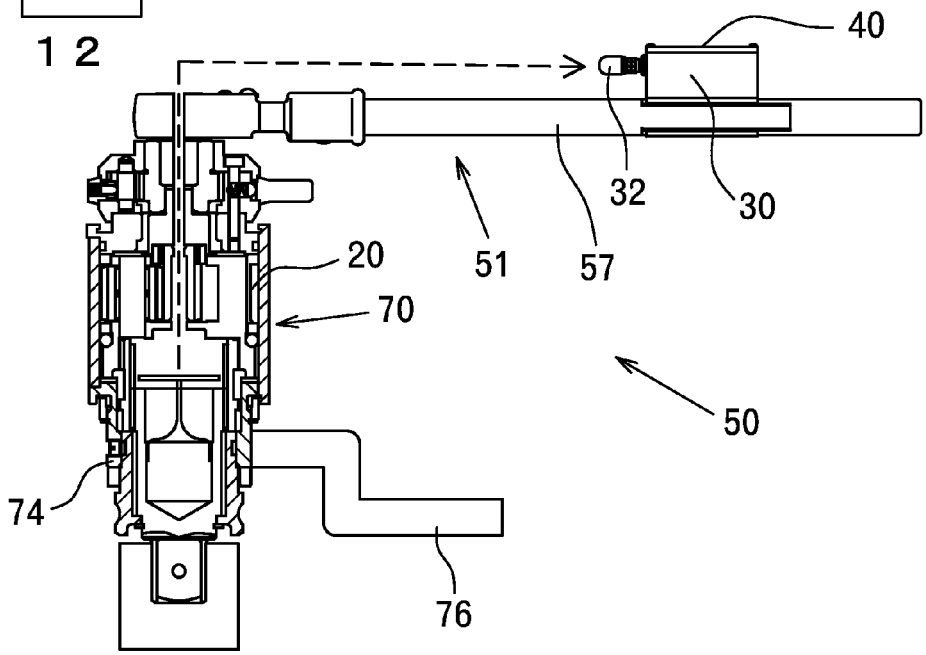
FIG. 12 is a partial cross-sectional diagram showing an example in which the present invention is applied to a manual wrench.

FIG. 12 shows an example in which the present invention is applied to the tightening machine 50 made up of a manual wrench 51 and a power booster 70. The power booster 70 has a planetary gear mechanism 72, and a reaction force receiver 76 is disposed in a terminal-end external cylinder 74.

The data transmitting unit 20 is disposed inside the power booster 70, the data receiving unit 30 is attached to the handle portion 57 of the wrench 51.

In the wrench 51 of the present configuration, a user grips the handle portion 57 and tightens a bolt or the like manually, by which the tightening torque is wirelessly transmitted from the data transmitting unit 20 to the data receiving unit 30, so that the tightening torque can be visually checked on the display means 70 of the handle portion 57.

While in the above-described example, the motor 54 is exemplified as the power machine, the power machine is not limited to the electric one, but a pneumatic or hydraulic one can also be used.

The present invention is useful as the wireless data transmitting and receiving system that directly detects the tightening torque and/or the rotary angle of the rotary shaft from the rotary shaft of the tightening machine, and wirelessly transmits and receives the same to feed back to the tightening machine or to transmit to the personal computer or the like so that various controls and the like can be performed.

What is claimed is:

1. A wireless data transmitting and receiving system comprising:

a data transmitting unit provided on a rotary shaft of a tightening machine and having a function of detecting a torque, the data transmitting unit including a torque sensor disposed so as to be capable of sensing a torque acting on the rotary shaft, and transmitting means that is electrically connected to the torque sensor and wirelessly transmits a signal regarding the torque detected in the torque sensor; and a data receiving unit including receiving means that receives the signal regarding the torque transmitted from the transmitting means of the data transmitting unit, and display means that displays the signal regarding the torque received by the receiving means.

2. The wireless data transmitting and receiving system according to claim 1, wherein: the data transmitting unit includes a rotation angle sensor disposed so as to be capable of sensing a rotation angle of the rotary shaft and electrically connected to transmitting means;

the transmitting means wirelessly transmits a signal regarding the rotation angle detected in the rotation angle sensor and;

the data receiving unit includes receiving means that receives the signal regarding the rotation angle transmitted from the transmitting means of the data transmitting unit and display means that displays the signal regarding the rotation angle received by the receiving means.

3. The wireless data transmitting and receiving system according to claim 2, wherein the data receiving unit is disposed on a body side of the tightening machine or inside a housing on a power wire that supplies power to the body, and includes, inside the tightening machine or the housing, a control circuit that controls a power machine rotating the rotary shaft, the control circuit being electrically connected to the receiving means to control the power machine based on the signal regarding the rotation angle received by the receiving means.

4. The wireless data transmitting and receiving system according to claim 2, wherein the data receiving unit determines whether or not the rotation angle is acceptable based on the signal regarding the rotation angle received by the receiving means, and has notifying means that notifies the determination of the acceptance or nonacceptance.

5. The wireless data transmitting and receiving system according to claim 2, wherein storage means that accumulates the signal regarding the rotation angle detected in the rotation angle sensor is included in any one of the data transmitting unit and the data receiving unit.

6. The wireless data transmitting and receiving system according to claim 2, wherein the rotation angle sensor is an encoder, a gyro sensor, a photo interrupter, or a magnetic sensor.

7. The wireless data transmitting and receiving system according to claim 1, wherein the data receiving unit is fixed to a body of the tightening machine.

8. The wireless data transmitting and receiving system according to claim 1, wherein the data receiving unit is disposed on a body side of the tightening machine or inside a housing on a power wire that supplies power to the body, and includes, inside the tightening a machine or the housing, a control circuit that controls a power machine rotating the rotary shaft, the control circuit being electrically connected to the receiving means to control the power machine based on the signal regarding the torque received by the receiving means.

9. The wireless data transmitting and receiving system according to claim 1, wherein the data receiving unit determines whether or not the torque is acceptable based on the signal regarding the torque received by the receiving means, and has notifying means that notifies the determination of the acceptance or nonacceptance.

10. The wireless data transmitting and receiving system according to claim 1, wherein the data transmitting unit has a plurality of antennas.

11. The wireless data transmitting and receiving system according to claim 1, wherein storage means that accumulates the signal regarding the torque detected in the torque sensor is included in any one of the data transmitting unit and the data receiving unit.

12. The wireless data transmitting and receiving system according to claim 1, wherein the rotary shaft includes an inner shaft and an outer shaft rotatable in a reverse direction to each other, and the data transmitting unit is disposed in any one of the shafts.

13. The wireless data transmitting and receiving system according to claims 1, wherein the data transmitting unit is detachable.

14. The wireless data transmitting and receiving system according to claim 1, wherein the data transmitting unit has identification means for identifying its own machine with data receiving unit.

15. The wireless data transmitting and receiving system according to claim 1, wherein a deceleration mechanism is disposed between the rotary shaft and the power machine, and the rotation is transmitted from the power machine to the rotary shaft through the deceleration mechanism.

16. The wireless data transmitting and receiving system according to claim 1, wherein the torque sensor is a strain gauge.

* * * * *